United States Patent [19]

Nagai et al.

[11] 4,138,915

[45] Feb. 13, 1979

[54] ELECTRONIC MUSICAL INSTRUMENT PRODUCING TONES BY VARIABLY MIXING DIFFERENT WAVESHAPES

[75] Inventors: Yohei Nagai; Shimaji Okamoto, both of Hamamatsu, Japan

[73] Assignee: Nippon Gakki Seizo Kabushiki Kaisha, Hamamatsu, Japan

[21] Appl. No.: 773,788

[22] Filed: Mar. 2, 1977

[30] Foreign Application Priority Data

Mar. 5, 1976 [JP] Japan ..... 51/23795

[51] Int. Cl.[2] ..... G10H 1/06

[52] U.S. Cl. ..... 84/1.22; 84/1.19; 84/1.01; 84/1.23

[58] Field of Search ..... 84/1.01, 1.19, 1.2, 84/1.22, 1.23, 1.25, 1.26

[56] References Cited

U.S. PATENT DOCUMENTS

| | | | |
|---|---|---|---|
| 3,443,463 | 11/1969 | Campbell | 84/1.01 |
| 3,836,693 | 9/1974 | Ichikawa | 84/1.23 |
| 3,992,970 | 11/1975 | Chibana et al. | 84/1.19 |

*Primary Examiner*—Robert K. Schaefer
*Assistant Examiner*—Leonard W. Pojunas, Jr.
*Attorney, Agent, or Firm*—Cushman, Darby & Cushman

[57] ABSTRACT

An electronic musical instrument of a waveshape memory type comprising: a plurality of waveshape memories for storing waveshapes of different tone color, and means for variably mixing the outputs of the plurality of waveshape memories for generating tone signals of varying tone color. The mixing ratio of the different waveshapes may be varied with the lapse of time or according to the touch of the key operation or to the tone pitch.

9 Claims, 22 Drawing Figures

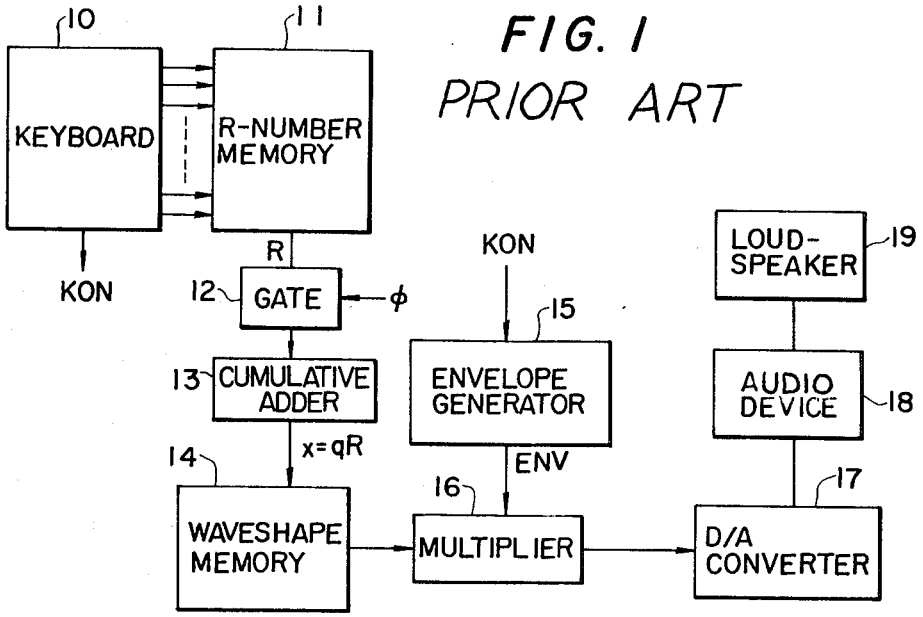
FIG. 1
PRIOR ART
FIG. 2a
FIG. 2b
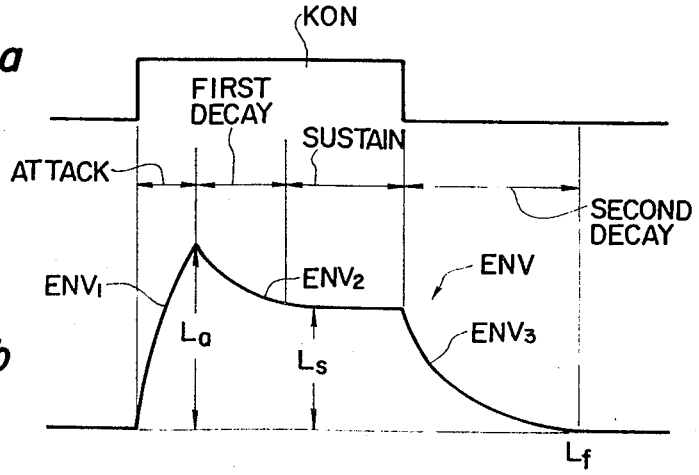

ELECTRONIC MUSICAL INSTRUMENT PRODUCING TONES BY VARIABLY MIXING DIFFERENT WAVESHAPES

BACKGROUND OF THE INVENTION (a) Field of the Invention

The present invention relates to an electronic musical instrument, and more particularly it pertains to a digital electronic musical instrument of a waveshape memory type.

(b) Description of the Prior Art

In an electronic musical instrument of a waveshape memory type, the waveshape of the musical tone signal is preliminarily stored in a memory means and is read out upon each key depression at a predetermined speed corresponding to the tone pitch of the depressed key. An example of such an electronic musical instrument of a waveshape memory type is shown in FIG. 1. When a key in a keyboard 10 is depressed, a key-on signal KON is generated from the keyboard means 10. Also, the key depression actuates a reference number memory 11 (referred to as R number memory hereinbelow) to generate a reference number (referred to as R number hereinbelow) which is related with the depressed key and is proportional to the fundamental frequency of a tone to be sounded. The R number read out from the R number memory 11 is transferred to a cumulative adder 13 through a gate 12 which is controlled by a clock pulse $\phi$ of a constant period. The adder 13 cumulatively adds the R number supplied from the R number memory 11 at the timing of said clock pulse $\phi$ and supplies the temporary sum to a waveshape memory 14 as its address signal. Namely, the adder 13 delivers R (number below radix point, in general) at the timing of the first pulse $\phi$, 2R at the timing of the second pulse $\phi$ and similarly qR at the timing of the q-th pulse $\phi$, to call the addresses of the respective waveshape samples in the waveshape memory 14. The adder 13 contains integer digits and fraction (below radix point) digits and has a modulus of a certain number, e.g. 128. Thus, the output of the adder 13, $x = qR$ ($q = 1, 2, \ldots$), increases from zero to the modulus with a pitch of R, and when the sum exceeds the modulus, the difference between the sum and the modulus is left in the adder 13 and similar cumulative addition is performed thereon. Since the R number added to the adder 13 is proportional to the fundamental frequency of the musical tone to be sounded, the rate of change of the sum $x = qR$, i.e. the repetition frequency of the stepping-up in the adder, is also proportional to the fundamental frequency of the musical tone to be sounded. Therefore, when the number of stages or memory samples in the waveshape memory 14 is set equal to the modulus of the adder 13, the frequency of the waveshape production from the waveshape memory 14 also changes in proportion to the magnitude of the R number. In other words, when the number of samples in the waveshape memory is 128 and the timing pulse $\phi$ has a repetition period of $T_0$, the repetition frequency f of the waveshape production from the waveshape memory 14 becomes $f = (R/T_0)/128 = R/(128 \cdot T_0)$ (Hz). That is, when a larger R number is generated, the output of the waveshape memory 14 varies rapidly and the repetition period of the waveshape production becomes short to generate a high frequency musical tone. On the other hand, when a small R number is generated, a low frequency musical tone is produced. The details of such functions are disclosed in Japanese Patent Laid-open Publication No. 48-90217 (corresponding to U.S. Pat. No. 3,809,786 to Ralph Deutsch issued on May 7, 1974).

The digital information read out from the waveshape memory 14 and constituting the waveshape of the musical tone of a desired tone pitch is multiplied with an envelope information derived from an envelope generator 15 in a multiplier 16 to be afforded with a tone envelope and then it is transferred to a digital-to-analog (D/A) converter 17 to generate a corresponding analog signal. This analog signal is sounded as a musical tone in a loudspeaker 19 through an audio device 18 including an amplifier, etc.

The envelope generator 15 is activated by the key-on signal KON as shown in FIG. 2A generated by the depression of a key in the keyboard 10, and gives an envelope ENV as shown in FIG. 2B having the attack, the first decay to sustain and second decay, envelopes $ENV_1$, $ENV_2$, and $ENV_3$ to the waveshape signal generated from the waveshape memory 14 to form an expressive musical tone signal. That is, the envelope of FIG. 2B shows how the musical sound grows to the maximum amplitude upon depression of a key (attack), attenuates to a sustain level (first decay), keeps the constant amplitude (sustain), and gradually vanishes (second decay) upon release of the key.

As can be seen from the statement made above, according to the above-mentioned electronic musical instrument of a waveshape memory type, since the information of a predetermined waveshape is stored in the memory, the musical sound to be generated has only a variable envelope with a fixed tone color from the attack to the last decay. This is far from the rich sound of a natural musical instrument. A natural musical sound has a variable tone color from the attack to the decay.

SUMMARY OF THE INVENTION

It is, therefore, an object of the present invention to provide an electronic musical instrument capable of generating musical sounds, the tone color of which varies with the lapse of time and/or the touch of the key operation.

According to an aspect of this invention, there is provided an electronic musical instrument of a waveshape memory type which reads out the waveshape information of an intended musical tone from a waveshape memory means at a predetermined speed to generate a musical tone, in which the waveshape memory means comprises a plurality of waveshape memory units for storing the waveshapes of different tone colors, and the mixing ratio of the outputs of the plurality of waveshape memory units is varied at a desired rate with the lapse of time and/or the touch of the key operation.

Further objects, features and advantages of the present invention will become apparent from the following detailed description of the preferred embodiments when taken in conjunction with the accompanying drawings.

BRIEF DESCRIPTION OF THE DRAWINGS

FIG. 1 is a block diagram of a conventional electronic musical instrument of a waveshape memory type.

FIGS. 2A and 2B are diagrams of the waveshape of a key-on signal and an envelope function signal.

DESCRIPTION OF THE PREFERRED EMBODIMENTS

Figure 3:
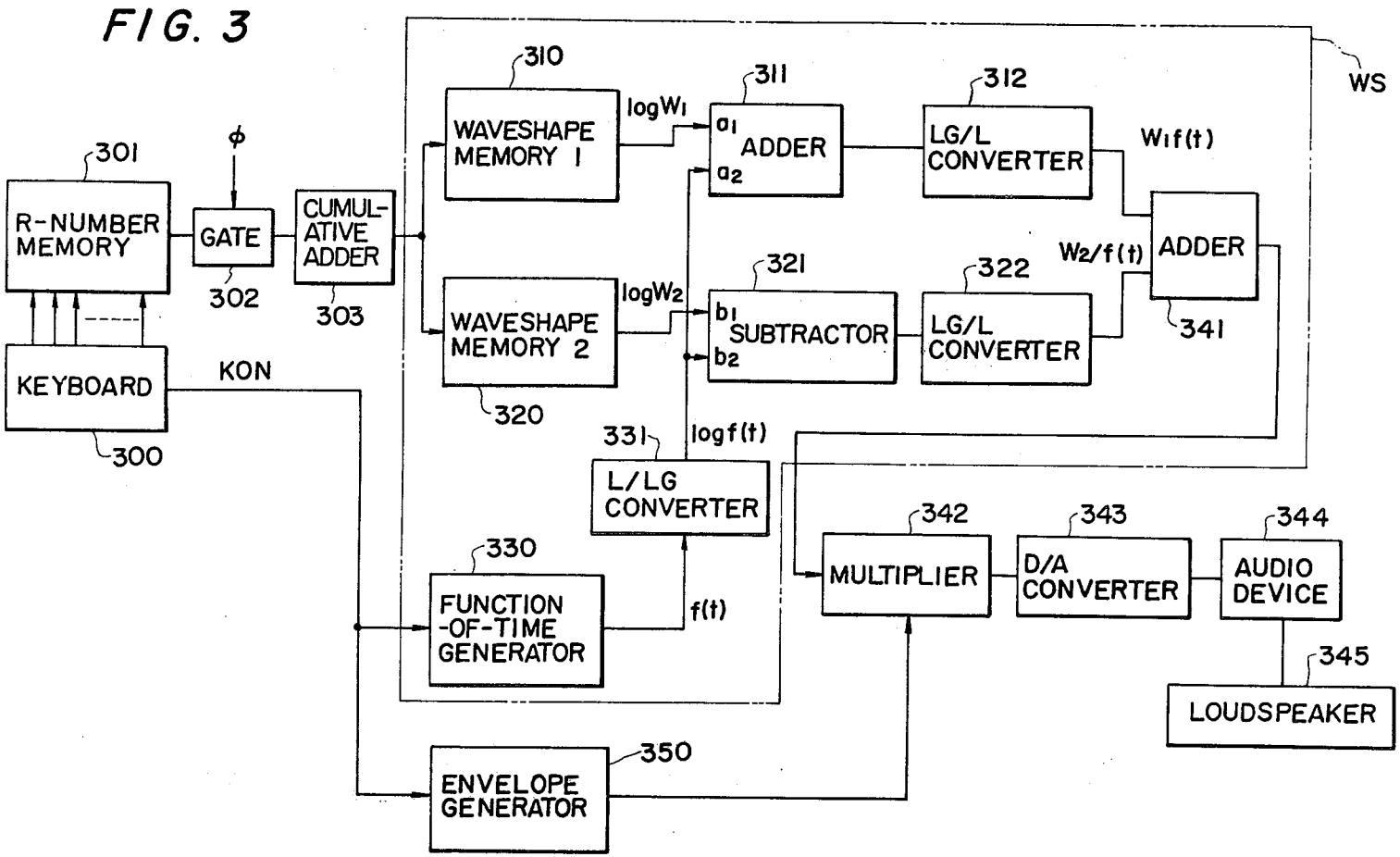
FIG. 3 is a block diagram of an electronic musical instrument of a waveshape memory type according to an embodiment of this invention.

FIG. 3 shows an electronic musical instrument according to an embodiment of this invention, which has a similar basic structure to that of FIG. 1. Namely, when a key in a keyboard 300 is depressed, an R number memory 301 is actuated to generate a corresponding R number while a key-on signal KON is generated from the keyboard 300. The R number is supplied to a cumulative adder 303 (similar to the cumulative adder 13 of FIG. 1) through a gate 302 which is opened and closed at the timing of a clock pulse $\phi$. The output of this adder 303 calls the addresses of waveshape memories 310 and 320 in a waveshape generating and mixing means WS to provide digital information representing sample values of the waveshape of the musical tone. The digital information generated from the waveshape generator-mixer WS is multiplied with the envelope signal generated from an envelope generator 350 in a multiplier 342 to form an expressive digital tone signal, which is then converted to an analog signal in a digital-to-analog (D/A) converter 343. This analog signal is sounded as a musical tone in a loudspeaker 345 through an audio device 344.

In this circuit, the conventional waveshape memory (14 in FIG. 1) is substituted by a waveshape generator-mixer WS which includes a pair of waveshape memories 310 and 320 of similar structure for storing different waveshapes and means for mixing the outputs of these memories. These waveshape memories 310 and 320 store sample values of predetermined waveshapes in logarithmic representation and are addressed simultaneously by the output of the adder 303. The first waveshape memory 310 supplies an output log $W_1$ to one input terminal $a_1$ of an adder 311 and the second waveshape memory supplies an output log $W_2$ to one input terminal $b_1$ of a subtractor 321. Thus, the digital information of the musical tone supplied from the first waveshape memory 310 appears at the input terminal $a_1$ of the adder 311 with the lapse of time and the digital information of the musical tone supplied from the second waveshape memory 320 appears at the input terminal $b_1$ of the subtractor 321 with the lapse of time. The other input terminals $a_2$ and $b_2$ of the adder 311 and the subtractor 321 are applied with a signal log f(t) which is formed by log-converting the output f(t) of a function-of-time generator 330 in a linear-to-logarithmic converter 331 (referred to as L/LG converter hereinbelow). The function-of-time generator 330 is actuated by the key-on signal KON supplied from the keyboard 300 and generates a function-of-time f(t) with the lapse of time.

The adder 311 adds up the output log $W_1$ of the first waveshape memory 310 and the logarithm log f(t) of the output f(t) of the function-of-time generator 330 log-converted in a L/LG converter 331, to generate $\log W_1 + \log f(t) = \log[W_1 \cdot f(t)]$, while the subtractor 321 subtracts the logarithm log f(t) of the output f(t) of the function-of-time generator 330 from the output $W_2$ of the second waveshape memory 320 to generate $\log W_2 - \log f(t) = \log[W_2/f(t)]$. These logarithmic outputs $\log [W_1 \cdot f(t)]$ and $\log[W_2/f(t)]$ of the adder 311 and the subtractor 321 are inverted into linear scale representation $W_1 f(t)$ and $W_2/f(t)$ in logarithmic-to-linear converters 312 and 322 (hereinbelow referred to as LG/L converter). These signals $W_1 f(t)$ and $W_2/f(t)$ form two inputs of an adder 341, which supplies $W_1 f(t) + W_2/f(t)$ to the multiplier 342. Then, similar to the circuit of FIG. 1, the multiplier 342 gives an envelope to the digital tone signal $W_1 f(t) + W_2/f(t)$. The resultant digital tone signal is converted into an analog signal in a D/A converter 343 and sounded as a musical tone in a loudspeaker 345 through an audio device 344.

As can be seen from the output $W_1 f(t) + W_2/f(t)$ of the adder 341, the outputs $W_1$ and $W_2$ of the first and second waveshape memories 310 and 320 are mixed at a ratio determined by the time-dependent output f(t) of the function-of-time generator 330. Therefore, if the function f(t) is an increasing function of time t, the ratio of the output $W_1$ increases and that of the output $W_2$ decreases with the lapse of time t. To the contrary, if the function f(t) is a decreasing function, the ratio of the output $W_1$ decreases and that of the output $W_2$ increases with the lapse of time.

Figure 4:
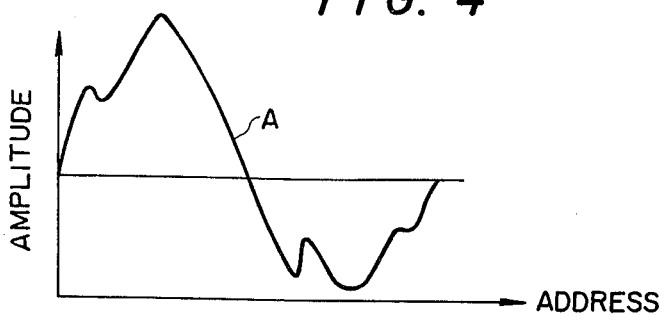
FIGS. 4 and 5 are diagrams of the waveshapes stored in the waveshape memory units of the embodiment of FIG. 3.
Figure 5:
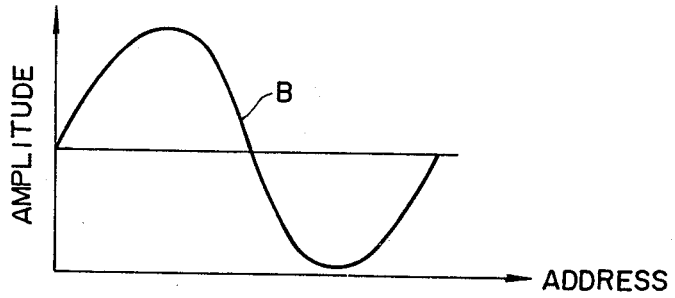

Generally, the musical sounds of natural musical instruments have a common property that much higher harmonics are included in the initial state of sounding but they attenuate gradually with the lapse of time to delicately change the tone color. Therefore, in order to provide musical sounds resembling those of the natural musical instrument by the embodiment of FIG. 3, such digital information which produces an amplitude waveshape as shown by the curve A of FIG. 4 with the address, i.e. the lapse of time, may be stored in the first waveshape memory 310 while the information which produces an amplitude waveshape as shown by the curve B of FIG. 5 may be stored in the second waveshape memory 320 and the output f(t) of the function-of-time generator 330 may be a decreasing function of time. Then, the mixing ratio of the waveshape A with respect to the waveshape B is high in the initial period, gradually decreasing with the lapse of time while the ratio of the waveshape B increases, and finally only the component of the waveshape B is sounded. That is, the higher harmonic components as shown by the waveshape A of FIG. 4 gradually decreases while the fundamental frequency component as shown by the waveshape B of FIG. 5 increases with the lapse of time to generate a musical sound resembling that of a natural musical instrument. Hereinbelow, description will be made of the respective circuit components.

Function-of-time Generator 330

Figure 6:
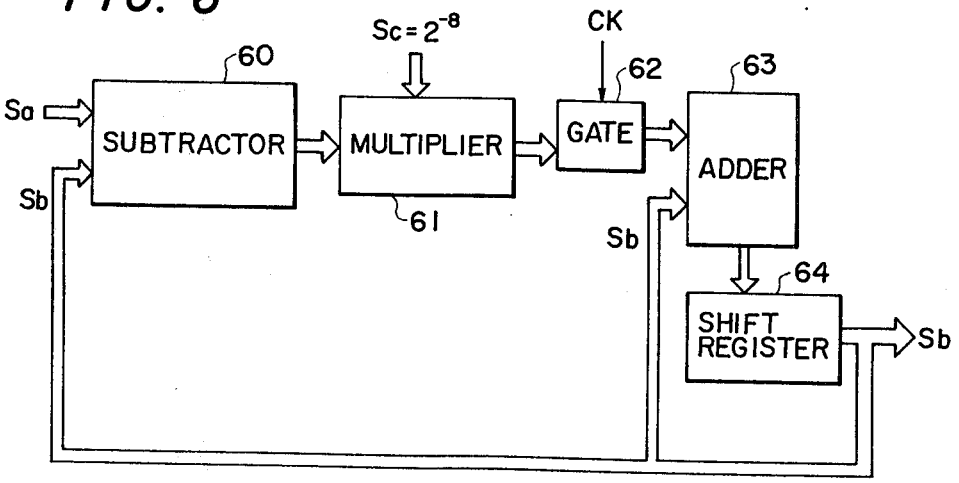
FIG. 6 is a block diagram of the function-of-time generator used in the embodiment of FIG. 3.

The function-of-time generator 330 generates a function-of-time f(t) which determines the mixing ratio of the outputs of the waveshape memories 310 and 320. Such a function-of-time generator may be constituted by a structure as shown in FIG. 6 which comprises a subtractor 60, a multiplier 61, a gate 62, an adder 63 and a shift register 64.

The subtractor 60 receives a first and a second input Sa and Sb and generates the difference D (which is Sa minus Sb) of the two inputs. As will be described later, the first input signal Sa is the aimed value signal set according to the required function output and the second input signal Sb is the temporary value signal which is the output of the shift register 64. The output of this subtractor 60, i.e. the difference D of the first and the second inputs Sa and Sb, is multiplied with a third signal Sc in the multiplier 61. The content of this third signal may be of an arbitrary value, for example equivalent to $2^{-8}$. Thus, the multiplier 61 supplies an output of $D \times 2^{-8}$. The multiplication constant $2^{-8}$ may also be obtained by shifting the difference signal D by eight digits in a binary register. The output of the multiplier 61 having the content of $D \times 2^{-8}$ is transferred to the adder 63 through the gate 62 at the timing of the clock pulse CK of a predetermined period. The timing of the clock pulse CK can be arbitrarily varied according to the required function output as will be described later.

The output signal (equivalent to $D \times 2^{-8}$) of the multiplier 61 transferred at a constant timing is added with the temporary output of the shift register 64 in the adder 63 and transferred to the one-stage shift register 64. The output signal Sb of the shift register 64 is the temporary value signal Sb which is subjected to the subtraction with the aimed value signal Sa in the subtractor 60.

Since the temporary value signal Sb is fed back to the subtractor 60 at each timing of the clock pulse CK, the difference between the signals Sa and Sb, which is the output of the subtractor 60, becomes successively small and hence the temporary value signal Sb approaches the aimed value signal Sa asymptotically.

Figure 7:
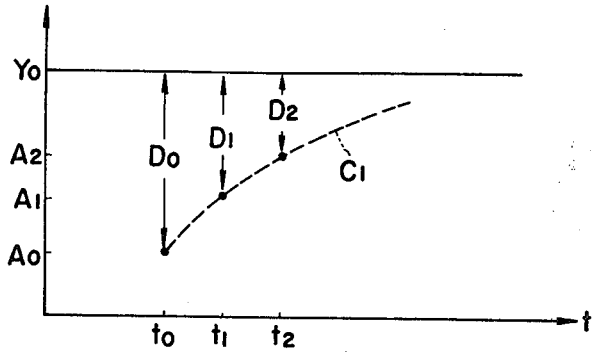
FIGS. 7 and 8 are characteristics curves for illustrating the operation of the function-of-time generator of FIG. 6.
Figure 8:
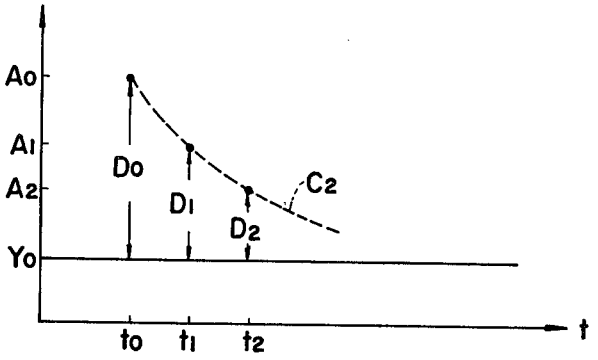

For example, as shown in FIGS. 7 and 8, when the aimed value signal Sa for the subtractor 60 is set at $Y_0$ and a temporary value Sb in the shift register 64 is $A_0$ at time $t_0$, the output of the subtractor 60, i.e. the difference $D_0$ between the aimed value $Y_0$ and the temporary value $A_0$, is $D_0 = Y_0 - A_0$ (this value is positive when $Y_0 > A_0$ and negative when $Y_0 < A_0$). This difference signal $D_0$ is multiplied with the multiplication constant $2^{-8}$ in the multiplier 61 to generate $D_0 \times 2^{-8}$. This increment or decrement $D_0 \times 2^{-8}$ is added to the temporary value $A_0$ in the adder 63 at the timing $t_1$ of the next clock pulse CK applied to the gate 62. Namely, the adder 63 generates $A_0 + D_0 \times 2^{-8}$ at the timing $t_1$ which is sent to the shift register 64 and supplied as a new temporary value $A_1$.

This new temporary value $A_1$ is fed back to the subtractor 60 and hence the subtractor 60 generates a new difference signal $D_1 = Y_0 - A_1$ (see FIGS. 7 and 8). By the similar processes as stated above, the multiplier 61 generates an output of $D_1 \times 2^{-8}$ and the adder 63 generates an output of $A_1 + D_1 \times 2^{-8}$ at the timing $t_2$. Namely, the temporary value output of the shift register 64 at the timing $t_2$ is $A_2 = A_1 + D_1 \times 2^{-8}$.

In this manner, the temporary value output of the shift register 64 exponentially and asymptotically approaches the aimed value $Y_0$ at the timing $t_0, t_1, t_2, \ldots$ of the clock pulse CK. In other words, the difference D of the aimed value $Y_0$ and the temporary value A decreases in absolute value by a ratio of $(1-2^{-8})$ at each cycle to become $D = (Y_0 - A_0)(1 - 2^{-8})^n$ where n indicates the n-th cycle and the temporary value A varies as $A = Y_0 - D = Y_0 - (Y_0 - A_0)(1 - 2^{-8})^n$. Since $(1-2^{-8})$ is positive, the value A is monotonically increasing or decreasing function of time according to whether $Y_0$ is larger or smaller than $A_0$. FIG. 7 shows the case of increasing A and FIG. 8 shows the case of decreasing A (precisely, the sampling is achieved at a constant period and hence the temporary value A varies in a stepwise manner).

Thus, a function-of-time waveshape having an arbitrary time derivative can be formed by appropriately selecting the aimed value Sa, multiplication constant Sc for the multiplier 61 and the timing of the clock pulse CK. That is, if the multiplication constant Sc is set large and/or the timing (period) of the clock pulse CK is set short, a steep curve can be provided. If the timing (period) of the clock pulse CK is selected to be long, a more gentle slope is provided.

As described above, a desired time derivative of the function-of-time waveshape can be selected by appropriately setting the aimed value Sa, the multiplication constant Sc of the multiplier 61 and the timing of the clock pulse CK.

Envelope Generator 350

It will be understood that an envelope waveshape ENV as shown in FIG. 2B can be formed arbitrarily by successively setting and varying the aimed value and the timing of the clock pulse on the basis of the principles of the function-of-time generator 330 as described above.

Figure 9:
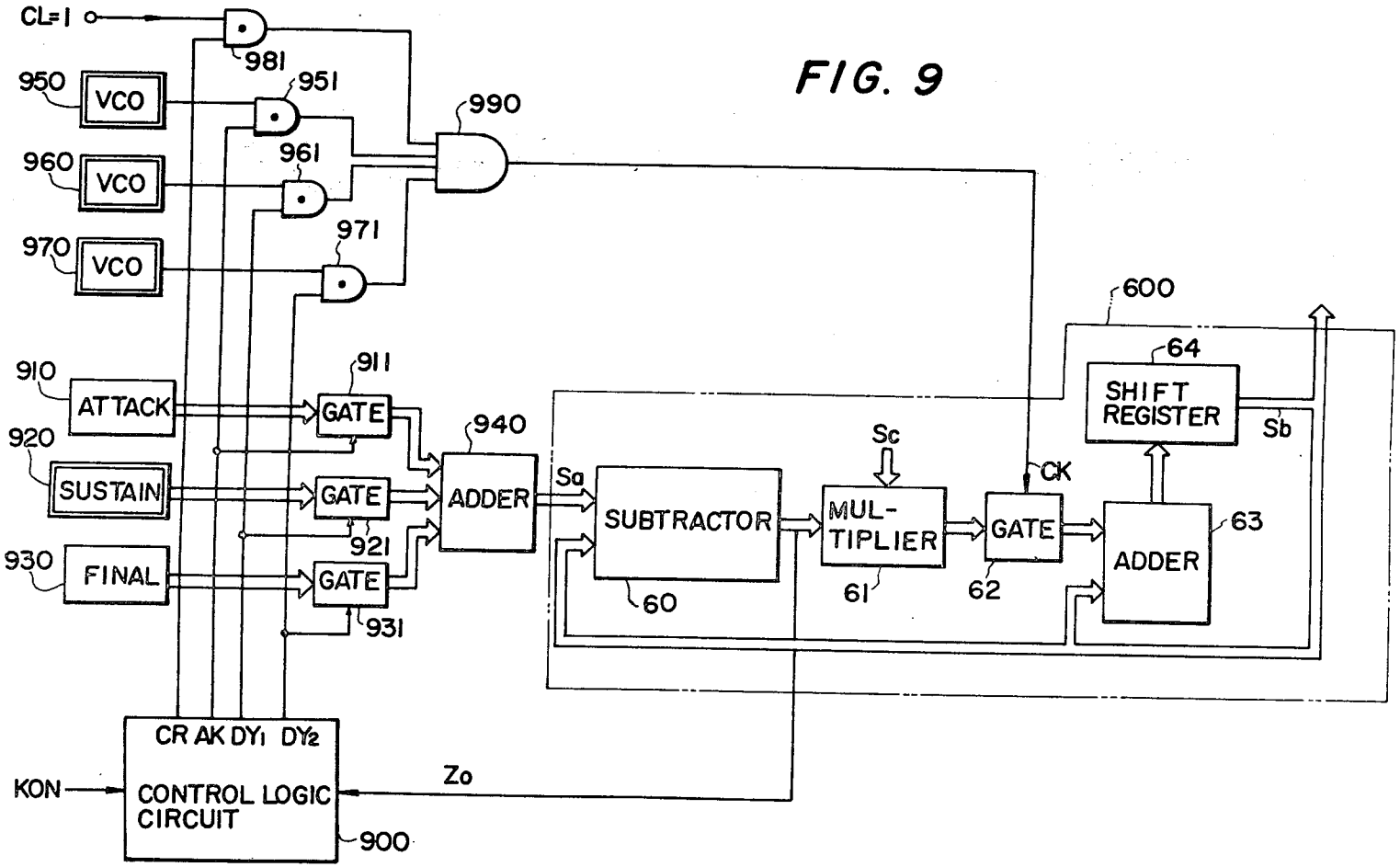
FIG. 9 is a block diagram of the envelope generator used in the embodiment of FIG. 3.

FIG. 9 shows a structure of such an envelope generator, in which a circuit block 600 indicates a similar circuitry to the function-of-time generator 330 as described before. Therefore, the description of the block 600 is omitted.

The other portion of FIG. 9 shows oscillator means for supplying the clock pulse CK, level setting means for supplying the aimed value signal Sa and control logic circuit means generating control sequence pulses for activating these means. These circuit means are all for supplying required parameters to the circuit 600 for generating the envelope waveshape.

The aimed value setting circuit includes an attack level setter 910 for setting the attack level La (see FIG. 2B), to which the initial tone level rises up, a sustain level setter 920 for setting the sustain level Ls to which the tone level falls after the attack and at which it remains, and a final level setter 930 for setting the final level to which the tone level falls and vanishes upon the release of a key. One of these level signals is selected at a time. Selection of these level signals (aimed value signals) is achieved by the associated operation of a control logic circuit 900, gates 911, 921 and 931 and an adder 940. Here, each of the level setters 910, 920 and 930 may be formed of a digital memory of, for example, 5-bit ROM. Among these level setters, the sustain level setter 920 may comprise a plurality of ROMs which can be changed over by an operator through a manual switch etc. provided in the operation panel of the electronic musical instrument or a RAM which can be rewritten. In such cases, the sustain level can be appropriately varied.

The setting of the clock pulse CK is achieved on the basis of a pulse generator 950 for the attack envelope, a pulse generator 960 for the first decay envelope, and a pulse generator 970 for the second decay envelope, and the selection of the clock pulses is achieved by the associated operation of the control logic circuit 900, AND circuits 951, 961 and 971 and an OR circuit 990. Each of the pulse generators 950, 960 and 970 may be formed of a voltage-controlled variable-frequency oscillator (VCO). A manual level switch may be provided on the operation panel of the electronic musical instrument through which the operator can arbitrarily select the oscillation frequency. Generally, however, it is preferable to set the pulse period for the attack envelope to be shorter than the pulse period for the first decay envelope and the pulse period for the first decay envelope to be shorter than the pulse period for the second decay envelope, in order to generat a musical tone envelope resembling that of a natural musical instrument (especially piano).

An AND circuit 981 receives a continuous clear signal CL (= "1") and a clear instruction signal CR generated from the control logic circuit 900. That is, when the clear instruction signal CR is generated, the clear signal CL is supplied to the gate 62 through an AND circuit 981 and an OR circuit 990 to substantially clear the content of the register 64.

The selection of the aimed value signal Sa and the clock pulse CK by the operation of the control logic circuit 900 will be described hereinbelow. The details of the logic circuit 900 will be described later.

When a key in the keyboard is depressed, a key-on signal KON is supplied to the control logic circuit 900 to generate an attack instruction signal AK. The attack instruction signal AK opens the gate 911 and establishes the AND condition for the AND circuit 951 to select the attack level setter 910 and the pulse generator 950 for the attack envelope.

Thus, the attack level La is supplied from the attack level setter 910 through the adder 940 to the circuit block 600 as the aimed value signal Sa, while the output pulse of the pulse generator 950 is supplied to the gate 62 of the circuit block 600 through the OR circuit 990 as the clock pulse CK.

In this way, an attack envelope $ENV_1$ as shown in FIG. 2B is formed by the circuit block 600 using the attack level La as the aimed value Sa and the pulse signal from the pulse generator 950 as the timing clock pulse CK. When the output of the circuit block 600, i.e. the temporary value Sb becomes equal to the aimed value Sa = La, the subtractor 60 of the circuit block 600 supplies zero detection signal $Z_0$ to the contorl logic circuit 900. Then, the logic circuit 900 generates a first decay instruction signal $DY_1$ for forming the first decaying state from the attack to the sustain. The first decay instruction signal $DY_1$ opens the gate circuit 921 and establishes the AND condition for the AND circuit 961 to select the sustain level setter 920 and the pulse generator 960 for the first decay envelope.

Thus, the sustain level Ls is supplied from the sustain level setter 920 through the adder 940 to the circuit block 600 as the aimed value Sa, while the pulse output of the pulse generator 960 is supplied through the OR circuit 990 to the gate 62 as the clock pulse CK.

Thus, the circuit block 600 generates a first decay and sustain envelope $ENV_2$ as shown in FIG. 2B using the sustain level Ls as the aimed value and the pulse train from the pulse generator 960 as the timing pulse CK. This state (first decay and sustain) continued while the key is being depressed and is terminated by the release of the key. Namely, when the key is released, the key-on signal KON vanishes and the control logic circuit 900 stops the first decay instruction signal $DY_1$ and generates a second decay instruction signal $DY_2$. Thus, if the time length from the depression to the release of a key is short, the envelope ENV of FIG. 2B may have little or no sustain state. Alternatively, if the time of key depression is prolonged, the sustain state will continue for a relatively long time.

As described above, upon release of the key, the second decay instruction signal $DY_2$ is generated from the control logic circuit 900 in place of the first decay instruction signal $DY_1$. Then, the gate 931 is opened and the AND condition for the AND circuit 971 is established to select the final level setter 930 and the pulse generator 970 for the second decay envelope.

Thus, the final level Lf is supplied from the final level setter 930 through the adder 940 to the circuit block 600 as the aimed value Sa, and the pulse output of the pulse generator 970 is supplied through the OR circuit 990 to the gate 62 of the circuit block 600 as the timing pulse CK.

In this manner, the second decay envelope $ENV_3$ as shown in FIG. 2B is generated from the circuit block 600 using the final level Lf as the aimed value and the output pulse of the pulse generator 970 as the timing pulse CK.

When the total waveshape of the envelope has been formed in the above manner, the control logic circuit 900 generates a clear instruction signal CR to supply the clear signal CL (= "1") to the gate 62 of the circuit block 600 through the AND circuit 981 and the OR circuit 990. Further, since the final level Lf which is zero is supplied from the final level setter 930 through the gate 931 and the adder 940 to the circuit block 600 as the aimed value Sa, the content of the shift register 64 is rapidly cleared to prepare for the next musical sound generation.

The exchange of the respective instruction signals from AK to $DY_1$ and from $DY_1$ to CR is achieved by the zero detection signal $Z_0$ which indicates that the output of the subtractor 60 has become "0" or almost "0". This point will be described in more detail in the next description of the control logic circuit 900.

Control Logic Circuit 900

Figure 10:
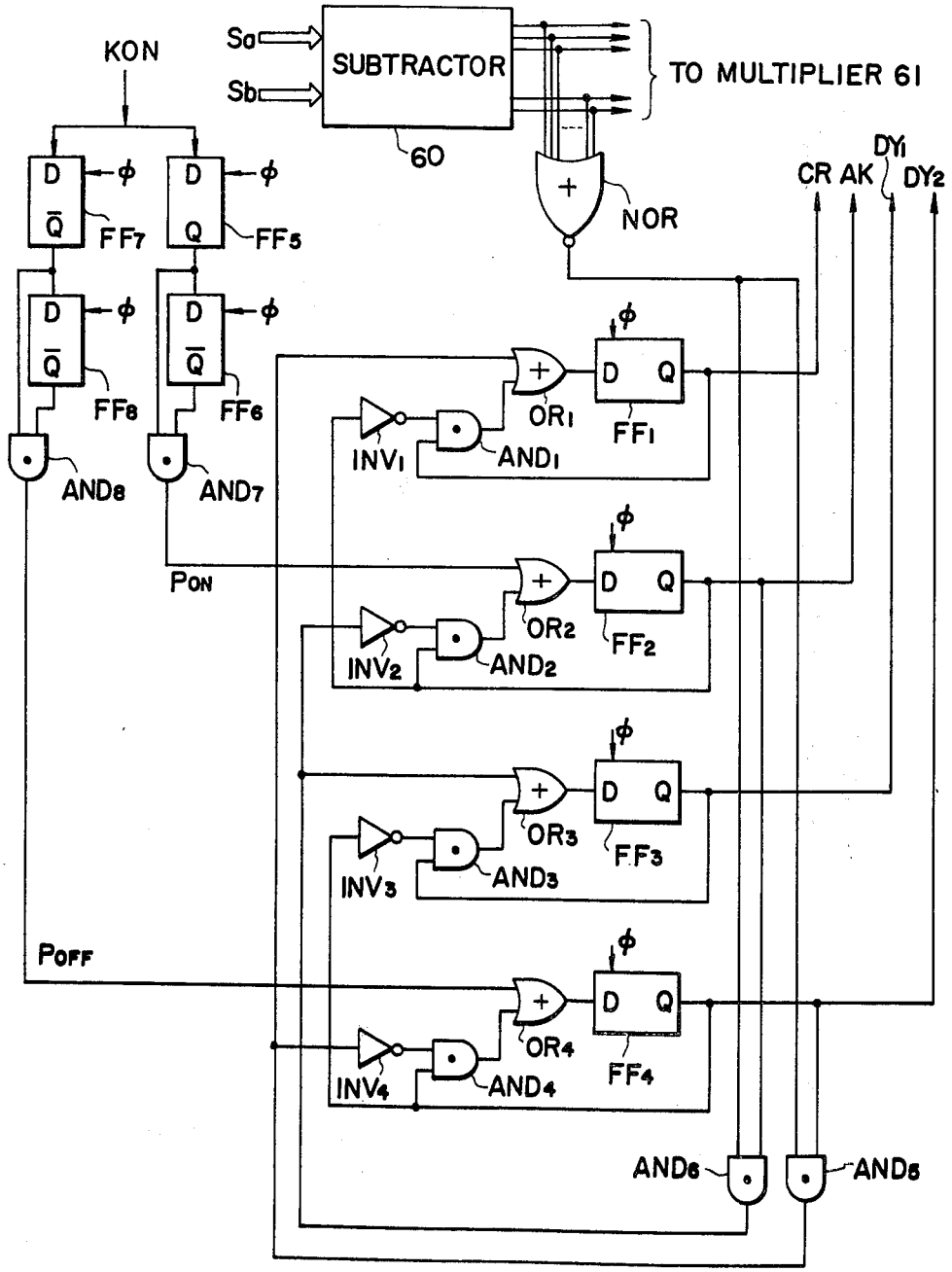
FIG. 10 is a block diagram of the control logic circuit of the envelope generator of FIG. 9.

The control logic circuit 900 may be formed of a structure as shown in FIG. 10, which is a combination of various logic elements: flip-flops $FF_1$ to $FF_8$, AND gates $AND_1$ to $AND_8$, OR gates $OR_1$ to $OR_4$, inverters $INV_1$ to $INV_4$, etc. The operation of this control logic circuit 900 responding to the key operation will be described hereinbelow.

Here, among the various logic elements, D-type flip-flops $FF_1$ to $FF_8$ are supplied with the similar clock pulse $\phi$ as that applied to the gate 12 or 302 of FIGS. 1 and 3 and are activated thereby.

Attack

Figure 11A:
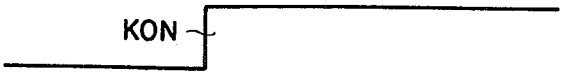
FIGS. 11A to 11E and 12A to 12E are time charts for illustrating the operation of the logic circuit of FIG. 10.
Figure 11B:
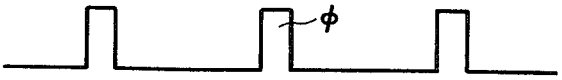
Figure 11C:
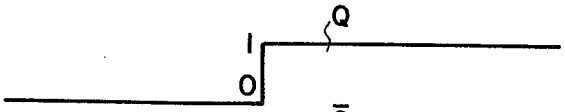
Figure 11D:
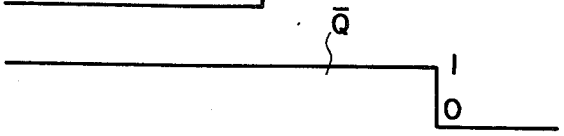

When a key-on signal KON (FIG. 11A) is generated upon the depression of a key, the flip-flop $FF_5$ is set by the clock pulse $\phi$ (FIG. 11B) to turn the Q output from "0" to "1" (FIG. 11C). Since this Q output of the flip-flop $FF_5$ is now "1", the next flip-flop $FF_6$ is set by the next clock pulse $\phi$ to turn the $\overline{Q}$ output from "1" to "0" (FIG. 11D). Thus, the AND circuit $AND_7$ generates an output "1" from the time when the flip-flop $FF_5$ is set until the time when the flip-flop $FF_6$ is set, as shown in FIG. 11E.

Figure 11E:
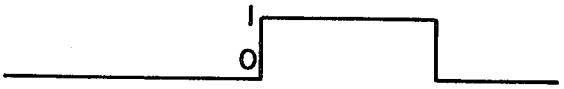

In other words, the flip-flops $FF_5$ and $FF_6$ and the AND circuit $AND_7$ generates an on-pulse $P_{ON}$ (FIG. 11E). In a similar manner, the flip-flops $FF_7$ and $FF_8$ and the AND circuit $AND_8$ generates an off-pulse $P_{OFF}$ (FIG. 12E) upon release of a key. When a key is being depressed, the AND circuit $AND_8$ generates no signal. Description will be made in the operational order.

The on-pulse $P_{ON}$ of the AND circuit $AND_7$ generated in the above manner is supplied through the OR circuit $OR_2$ to the flip-flop $FF_2$ to set this flip-flop $FF_2$. Thus, the flip-flop $FF_2$ generates the Q output which serves as the attack instruction signal AK and is also fed back to the flip-flop $FF_2$ through the AND circuit $AND_2$ and the OR circuit $OR_2$ to hold the signal level. Thus, the flip-flop $FF_2$ keeps generating the attack instruction signal AK even after the on-pulse $P_{ON}$ from the AND circuit $AND_7$ has vanished.

More particularly, the AND circuit $AND_2$ receives an input from the Q output of the flip-flop $FF_2$ as described above, and another input from the NOR circuit NOR through the AND circuit $AND_6$ and the inverter $INV_2$. The NOR circuit NOR receives the output of the subtractor 60. Thus, the NOR circuit NOR generates a zero detection signal $Z_0$ (= "1") when the temporary value Sb of the circuit block 600 becomes equal to the aimed value Sa and the difference D therebetween becomes "0", i.e. when the output of the subtractor 60 becomes "0". Thus, when the attack instruction signal AK is generated upon the depression of a key, the subtractor 60 generates a non-zero output and the NOR circuit NOR generates a zero output "0". Though the flip-flop $FF_2$ as a non-zero output in this state, the AND condition for the AND circuit $AND_6$ does not hold. Thus, the AND circuit $AND_6$ generates "0" output. Hence, the inverter $INV_2$ generates "1" output. The AND condition for the AND circuit $AND_2$ is fulfilled in this way to feed back the Q output to the flip-flop $FF_2$. Thus, the output of the flip-flop $FF_2$ is held even after the on-pulse $P_{ON}$ of the AND circuit $AND_7$ has vanished.

Similarly, the feed-back circuits for the flip-flops $FF_1$ to $FF_4$ formed of the OR circuit $OR_1$ to $OR_4$, the AND circuits $AND_1$ to $AND_4$ and the inverters $INV_1$ to $INV_4$ in FIG. 10 have functions of holding the output level of the flip-flops $FF_1$ to $FF_4$. Thus, the detailed description of these portions is omitted.

By the attack instruction signal AK being held in the above manner, the attack envelope $ENV_1$ is being formed. When the temporary value of the circuit block 600 reaches the attack level La, the output of the subtractor 60 becomes "0" and the NOR circuit NOR generates a zero detection signal $Z_0$ (= "1"). Thereby, the AND condition for the AND circuit $AND_6$ holds to supply "1" to the inverter $INV_2$. The AND condition for the AND circuit $AND_2$ vanishes by the output of the inverter $INV_2$ and the flip-flop $FF_2$ is reset to stop generating the attack instruction signal AK.

First Decay

At this moment, the flip-flop $FF_3$ is set by the output "1" of the AND circuit $AND_6$ through the OR circuit $OR_3$, to generate the Q output, which serves as the first decay instruction signal $DY_1$. Here, since the flip-flop $FF_4$ does not generate the output yet, the AND condition for the AND circuit $AND_3$ receiving the outputs of the flip-flops $FF_3$ and $FF_4$ directly and through the inverter $INV_3$ holds to keep the Q output of the flip-flop $FF_3$, i.e. the first decay instruction signal $DY_1$ similar to the case of the flip-flop $FF_3$. Thus, the first decay instruction signal $DY_1$ is held to establish the first decay envelope $ENV_2$ as described above. Meanwhile, the temporary value of the circuit block 600 reaches the sustain level Ls.

The first decaying state, however, can be terminated only by the key release operation and the sustain level Ls is continuously supplied as long as the key is depressed.

Figure 12A:
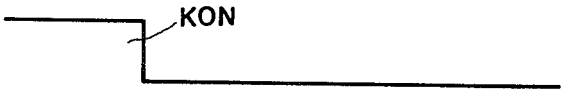
Figure 12B:
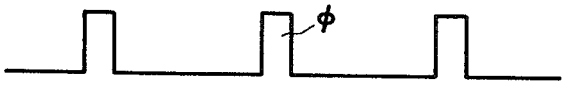
Figure 12C:
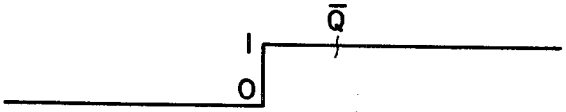
Figure 12D:
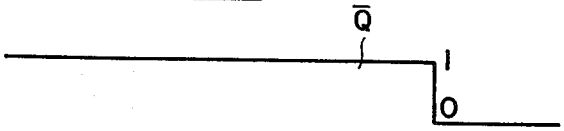
Figure 12E:
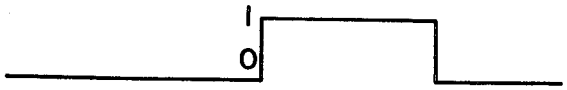

Next, the manner of terminating the first decaying state by the key release will be described. That is, when the key-on signal KON vanishes by the key release as shown in FIG. 12A, the flip-flop $FF_7$ is set by the clock pulse $\phi$ (FIG. 12B) to generate $\overline{Q}$ output (FIG. 12C). With the $\overline{Q}$ output of the flip-flop $FF_7$, the flip-flop $FF_8$ is reset by the next clock pulse $\phi$ to reset the $\overline{Q}$ output to "0" (FIG. 12D). Thus, the AND circuit $AND_8$ generates the output "1" (FIG. 12E) from the time when the flip-flop $FF_7$ is set until the time when the flip-flop $FF_8$ is reset. More specifically, the flip-flops $FF_7$ and $FF_8$ and the AND circuit $AND_8$ generate an off-pulse $P_{OFF}$ (FIG. 12E) upon the release of a key. Here, it will be apparent that the AND circuit $AND_7$ generates no output in contrast to the case of the key depression.

This output $P_{OFF}$ of the AND circuit $AND_8$ sets the flip-flop $FF_4$ through the OR circuit $OR_4$ to generate the Q output. This Q output is inverted by the inverter $INV_3$ and supplied to the AND circuit $AND_3$. Thus, the AND condition for the AND circuit $AND_3$ vanishes to reset the flip-flop $FF_3$, thereby terminating the generation of the first decay instruction signal $DY_1$.

Second Decay

The Q output of the flip-flop $FF_4$ which has led the flip-flop $FF_3$ into the reset state serves also as the second decay instruction signal $DY_2$. Since the AND condition of the AND circuit $AND_4$ is formed of the feedback signal of this Q output of the flip-flop $FF_4$ and the output signal of the inverter $INV_4$, the Q output of the flip-flop $FF_4$, i.e. the second decay instruction signal $DY_2$, is held. The inverter $INV_4$ generates the "1" output since the subtractor 60 generates an output by the second decay signal $DY_2$, hence the NOR circuit NOR generates no output and the AND condition for the AND circuit $AND_5$ does not hold similar to the case of producing the attack envelope.

As can be understood from the foregoing description, when the first decay instruction signal $DY_1$ is terminated by the release of a key, the second decay instruction signal $DY_2$ is generated. Then, the second decay envelope $ENV_3$ is established by the holding second decay instruction signal $DY_2$ as described above. Finally, when the temporary value of the circuit block 600 reaches the final level Lf, the output of the subtractor 60 becomes "0" and the NOR circuit NOR generates the zero detection signal $Z_0$ = "1". Then, the AND condition for the AND circuit $AND_5$ is established and hence the AND condition for the AND circuit $AND_4$ vanishes (due to the existence of the inverter $INV_4$) to reset the flip-flop $FF_4$ and terminate the generation of the second decay instruction signal $DY_2$.

Clear

The output of the AND circuit $AND_5$ which has led the flip-flop $FF_4$ to be reset is simultaneously supplied to the flip-flop $FF_1$ through the OR circuit $OR_1$ to set the flip-flop $FF_1$. Thus, the flip-flop $FF_1$ generates the Q output which serves as the clear instruction signal CR. It should be understood here that since the flip-flop $FF_2$ does not generate its output until the next key depression, the AND condition for the AND circuit $AND_1$ is held due to the existence of the inverter $INV_1$ and the Q output of the flip-flop $FF_1$, i.e. the clear instruction signal CR, is held. Description has already been made that the circuit block 600 is reset to prepare for the next day depression by this clear instruction signal CR.

In the above embodiment, the mixing ratio of the outputs of two waveshape memories is changed with the lapse of time. In the natural musical instrument, however, it is known that much higher harmonics are included in the musical sounds when (a) the tone volume is large or (b) the primary frequency of the sound is high.

Figure 13:
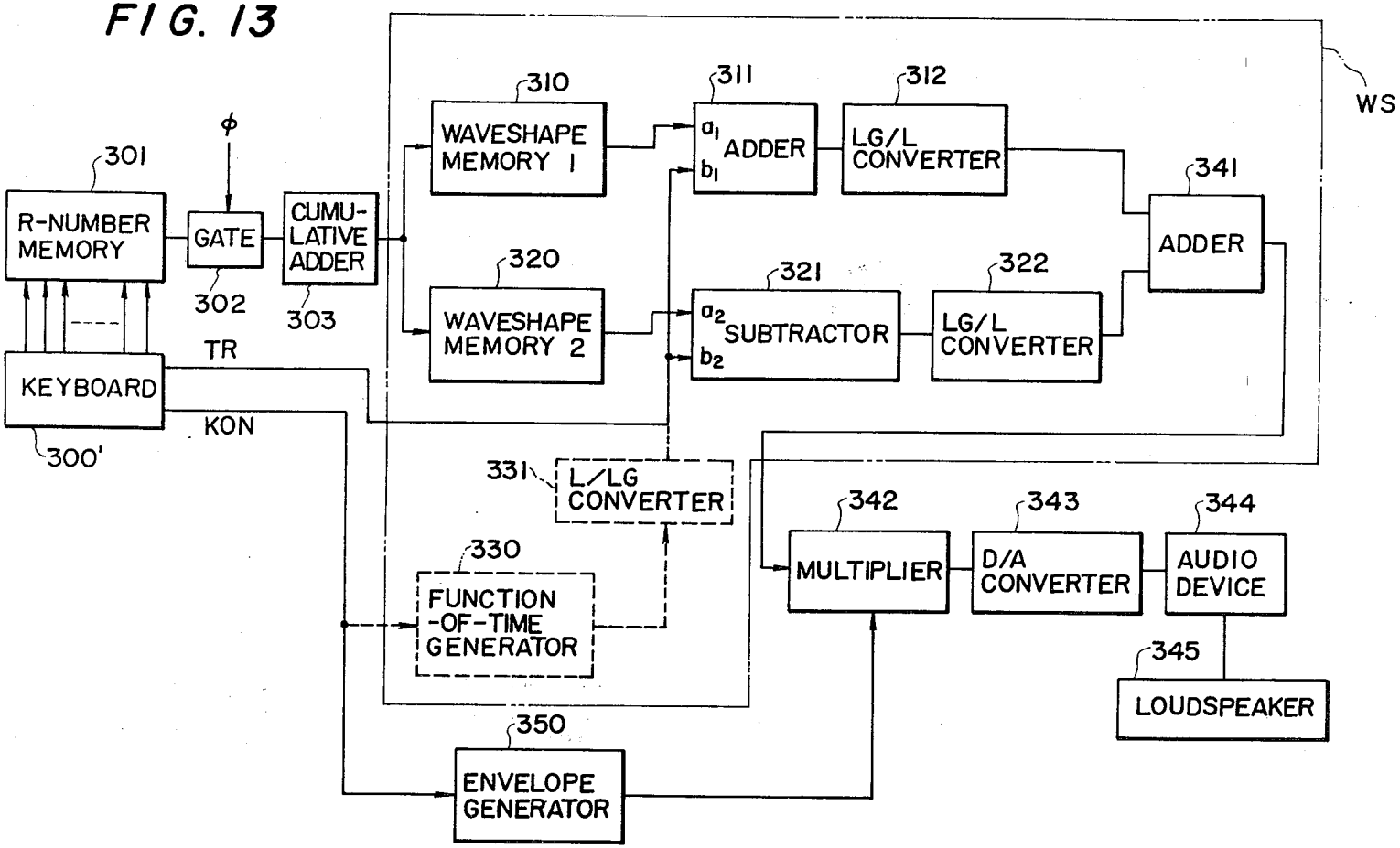
FIG. 13 is a block diagram of an electronic musical instrument of a waveshape memory type according to another embodiment of this invention.

Therefore, the mixing ratio of the higher harmonics may be altered in response to the touch of the key depression. FIG. 13 shows a touch-responsive electronic musical instrument in which the mixing ratio is varied according to the touch of the key depression. In this embodiment, the output TR of a touch-responsive keyboard 300' capable of detecting the strength of the touch is supplied to an adder 311 and a subtractor 321. In the figure, similar numerals with those of FIG. 3 indicate similar parts.

According to this embodiment, when a key is depressed strongly, the ratio of the output of the first waveshape memory 310 may be arranged to increase. Thus, much higher harmonics may be included in such cases.

Alternatively, it will be easily understood that the higher the frequency is the more higher-harmonics are included in the musical sound. Further, the function-of-time generator 330 and the L/LG converter 331 may be left as they are in the embodiment of FIG. 3, as shown by the dotted lines in FIG. 13, to change the mixing ratio of the outputs of the two waveshape memories 310 and 320 according to the lapse of time and to the key depression operation as described above.

It will be apparent that the mixing ratio of the outputs of the first and the second waveshape memories may not be changed to resemble the musical sounds of a natural musical instrument in any manner. Further, the respective constituents of the circuit in the above embodiments may be altered or modified in various ways according to the desired operation. Further, the keyboard including the touch-responsive one may be formed of any one of the known types.

It is also noted that the number of waveshape memories is not limited to two.

As has been described above, according to this invention, there is provided an electronic musical instrument comprising a plurality of waveshape memories for storing waveshapes of different tone colors and means for changing the mixing ratio of the outputs of the plurality of waveshape memories in a desired rate according to one or both of the lapse of time and the key depression operation, thereby generating musical tones of varying tone color according to one or both of the lapse of time and the key depression operation in spite of the use of the waveshape memory.

We claim:

1. An electronic musical instrument of a waveshape memory type comprising:

a plurality of waveshape memories for storing waveshapes of different tone colors and reproducing waveshape signals of said different tone colors;

means for mixing the waveshape signals from said plurality of waveshape memories;

means for controlling the mixing ratio of said waveshape signals, and in which said control means includes a function-of-time generator for generating a function-of-time signal, arithmetic means for achieving different arithmetic operations on said waveshape signals with said function-of-time signal to produce varying partial tone signals of said different tone colors and said mixing means is an adder for adding said varying partial tone signals.

2. An electronic musical instrument according to claim 1, in which said function-of-time generator includes at least one level setter for setting a signal level and at least one timing pulse generator for generating a pulse train of a constant pulse period and said function-of-time generator generates a function-of-time signal asymptotically approaching said signal level at a rate determined by said pulse period.

3. An electronic musical instrument of a waveshape memory type comprising:

a plurality of waveshape memories for storing waveshapes of different tone colors and reproducing waveshape signals of said different tone colors;

means for mixing the waveshape signals from said plurality of waveshape memories;

means for controlling the mixing ratio of said waveshape signals, and in which said electronic musical instrument includes a keyboard and said control means includes a touch-responsive signal generator for generating a touch-responsive signal having a level responsive to the touch of key depression in the keyboard and arithmetic means for achieving different arithmetic operations on said waveshape signals using said touch-responsive signal.

4. An electronic musical instrument according to claim 1, in which said plurality of waveshape memories are digital memories.

5. An electronic musical instrument according to claim 1, in which said plurality of waveshape memories are digital memories and said function-of-time signal is a digital signal.

6. An electronic musical instrument according to claim 1, in which said plurality of memories stores the waveshapes in logarithmic representation, said control means includes a linear-to-logarithmic converter for log-converting the function-of-time signal, and said arithmetic means includes an adder for performing logarithmic addition of one of said waveshape signals and the function-of-time signal and a subtractor for performing logarithmic subtraction of said function-of-time signal from the other of said waveshape signals.

7. An electronic musical instrument of a waveshape memory type, comprising:

a plurality of waveshape memories for storing waveshape of different tone colors;

means for variably mixing the outputs of said plurality of waveshape memories for generating tone signals of varying tone color, and in which said instrument is a keyboard musical instrument having keys for playing tones and the mixing ratio of the outputs of said plurality of waveshape memories is varied with the touch of said keys.

8. An electronic musical instrument according to claim 7, in which the mixing ratio of the outputs of said plurality of waveshape memories is varied with the lapse of time.

9. An electronic musical instrument according to claim 7, in which said waveshape memories are digital memories.

* * * * *